US005437062A

United States Patent [19]

Douglas

[11] Patent Number: 5,437,062

[45] Date of Patent: Aug. 1, 1995

[54] BASEBALL CAP WITH DETACHABLE VISOR

[76] Inventor: Bradley D. Douglas, 416 Green St. #3, Boone, Iowa 50036

[21] Appl. No.: 213,029

[22] Filed: Mar. 15, 1994

[51] Int. Cl.[6] ..... A42B 1/20

[52] U.S. Cl. ..... 2/195.1; 2/181; 2/181.4; 2/209.12; 2/10

[58] Field of Search ..... 2/10, 195.1, 209.11, 2/209.12, 209.13, 918, 171, 12, 181, 181.4, 181.2, 175.1, 909

[56] References Cited

U.S. PATENT DOCUMENTS

| | | | |
|---|---|---|---|
| 4,611,355 | 9/1986 | Galanto et al. . | |
| 4,630,317 | 12/1986 | Brown . | |
| 4,873,726 | 10/1989 | Tapia | 2/195.1 |
| 5,070,545 | 12/1991 | Tapia . | |
| 5,091,995 | 3/1992 | Oates | 2/10 |
| 5,099,524 | 3/1992 | Linday . | |
| 5,181,277 | 1/1993 | Sherman . | |
| 5,253,368 | 10/1993 | Blake | 2/209.13 |

FOREIGN PATENT DOCUMENTS

| | | | |
|---|---|---|---|
| 258359 | 9/1926 | United Kingdom . | |
| 2070413 | 9/1981 | United Kingdom . | |
| 2240029 | 7/1991 | United Kingdom | 2/195.1 |

*Primary Examiner*—Clifford D. Crowder
*Assistant Examiner*—Diana L. Biefeld
*Attorney, Agent, or Firm*—Henderson & Sturm

[57] ABSTRACT

A baseball cap construction (10) including:

a cap body member (20); at least one visor unit (12); and means (28) and (32) for selectively and releasably positioning the at least one visor unit (12) at a desired location around the periphery of the cap body member (20).

8 Claims, 2 Drawing Sheets

BASEBALL CAP WITH DETACHABLE VISOR

TECHNICAL FIELD

The present invention relates to the field of baseball cap constructions in general, and in particular to a baseball cap construction wherein one or more visors or brims may be selectively positioned around the periphery of the cap to produce a unique and variable changeable appearance.

BACKGROUND ART

As can be seen by reference to the following U.S. Pat. Nos. 5,070,545; 4,611,355; 4,630,317; and 5,099,524; the prior art is replete with myriad and diverse baseball cap constructions.

While all of the aforementioned prior art constructions are more than adequate for the basic purpose and function for which they have been specifically designed, and at least one patent even includes a provision for removably attaching a visor to the cap, these patented arrangements do not provide the wide range of adjustability and variety provided by the present invention in response to a widespread yet unspoken demand from the youngsters in this country who have adopted the habit of wearing a conventional billed cap in a variety of unconventional ways to exhibit their own individualism.

As a consequence of the foregoing situation, there has existed a longstanding need among todays youth for a new type of baseball cap construction that will allow the user to adapt a wide ranging variety of multi-colored visors to a basic cap body such that both the color and the orientation of the visor relative to the cap body can be infinitely varied; and, the provision of such a construction is a stated objective of the present invention.

DISCLOSURE OF THE INVENTION

Briefly stated, baseball cap construction that forms the basis of the present invention involves a cap body member provided with a first hook and loop fastener portion which at least substantially surrounds the lower periphery of the cap body.

In addition this invention also includes a plurality of interchangeable visor members which are provided with a second hook and loop fastener portion which allows the visor members to be selectively and removably attached to the cap body member.

As will be explained in greater detail further on in the specification, this invention also contemplates: the use of a grip tab associated with the visor members to facilitate the removal of the individual visor members from the cap member; the provision of a liner strip on the visor member to cover any exposed portions of the first hook and loop fastener portion on the interior of the cap body member; a dual crown on the cap body member so that the cap body member can be reversed relative to a single visor member; and, the use of more than one visor member in conjunction with a single cap body member.

BRIEF DESCRIPTION OF THE DRAWINGS

These and other attributes of the invention will become more clear upon a through study of the following description of the best mode for carrying out the invention, particularly when reviewed in conjunction with the drawings, wherein.

BEST MODE FOR CARRYING OUT THE INVENTION

Figure 1:
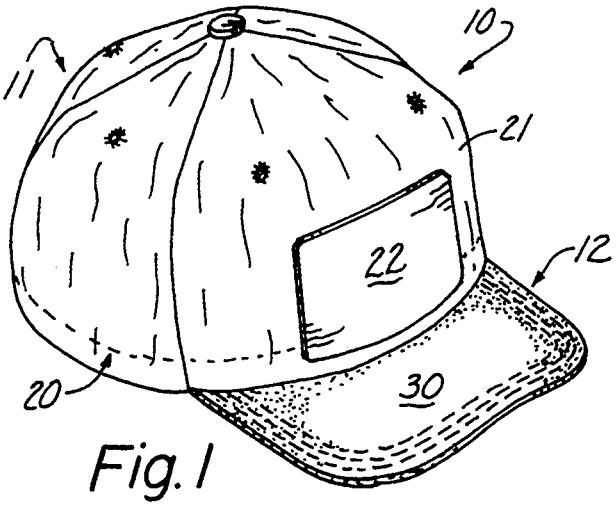
FIG. 1 is a perspective view of a baseball cap construction employing the teachings of this invention.
Figure 2:
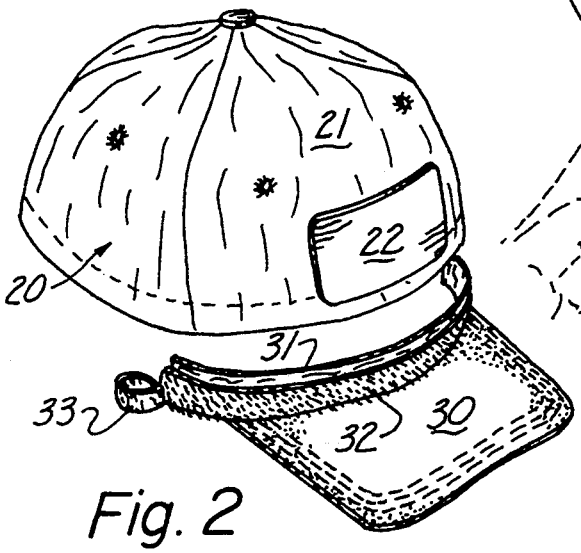
FIG. 2 is an exploded front perspective view of the cap construction depicted in FIG. 1.
Figure 3:
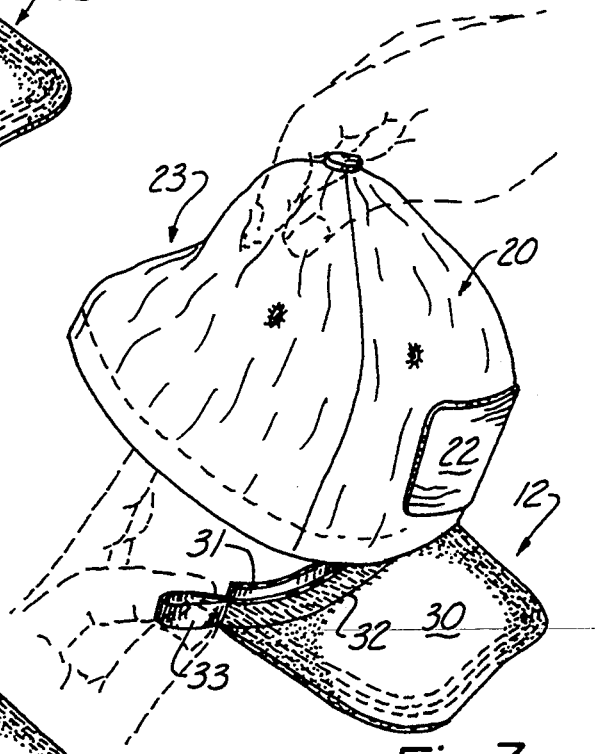
FIG. 3 is a view illustrating the detachable engagement between the cap body member and the visor member.

As can be seen by reference to the drawings, and in particular to FIG. 1, the baseball cap construction that forms the basis of the present invention is designated generally by the reference numeral (10). The cap construction (10) comprises in general a cap body unit (11) and a plurality of interchangeable visor units (12). These units will not be described in seriatim fashion.

In the first version of the preferred embodiment illustrated in FIGS. 1 through 5, the cap body unit (11) comprises a conventional adjustable size cap body member (20) having: a reinforced front crown portion (21) bearing an emblem or logo (22); a generally flexible rear portion (23) having an enlarged opening (24) formed therein; and, a pair of cooperating strap elements (25) (26) which extend across the mouth of the opening (24) to adjust the head encircling circumference of the cap body member (20) in a well recognized fashion.

Figure 4:
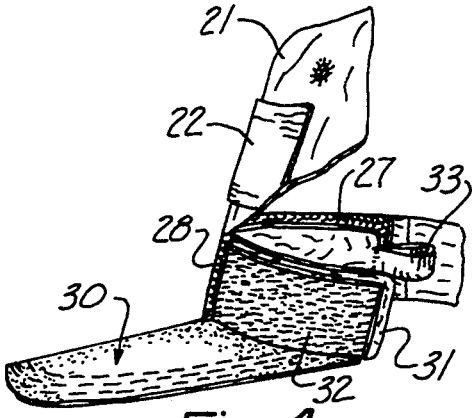
FIG. 4 is a partial cross-sectional view of the cooperative engagement between the visor member and the cap body member.
Figure 5:
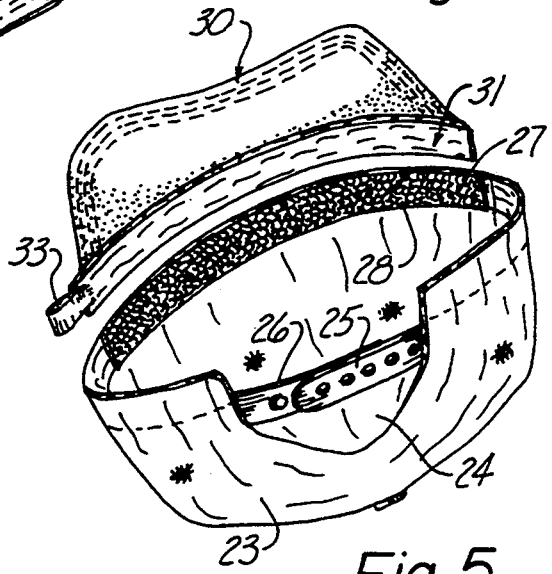
FIG. 5 is an exploded rear perspective view of the cap construction depicted in FIG. 1.

As can best be seen by reference to FIGS. 4 and 5, the inner periphery of the cap body member (20) is provided with an elongated strip (27) of a first hook and loop fastening component (28); wherein, the elongated strip (27) is secured to, and extends at least partially around, the lower inner periphery of the cap body member (20).

As shown in FIGS. 2 through 5, each one of the interchangeable visor units (12) comprise a generally stiff visor member (30) having a raised inboard lip (31); wherein, the front face of the lip (31) is covered by a second hook and loop fastening component (32) whose purpose and function will be explained presently.

In addition as is also shown in FIGS. 2 through 5, the raised visor lip (31) is further provided with a looped tab (33) which not only facilitates the removal of a particular visor member (30) from the cap body member (20), but also provides a means for suspending a number of visor members (30) from a hook or nail not shown for the purposes of display or storage.

In the alternate version of the preferred embodiment depicted in FIGS. 6 through 8 it can be seen that the cap construction of this invention further contemplates some rather marked deviations from what would normally be considered a "conventional" cap construction as will be explained presently.

To begin with the cap body member (20) is provided with a continuous uninterrupted periphery such that the front and rear portions of the cap body member (20) are virtual mirror images of one another.

In addition the entire inner periphery of the cap body member (20) is covered by a closed loop strip (27') of a first hook and loop fastening component (28); such that, the second hook and loop fastening component (32) on the raised lip (31) of the visor member (30) will allow the visor member (30) to be secured at any desired location around the entire periphery of the cap body member (20). Furthermore, this arrangement will also allow more than one visor body member (30) to be secured to a single cap body member (20) should the user decide to adopt that particular configuration.

Figure 6:
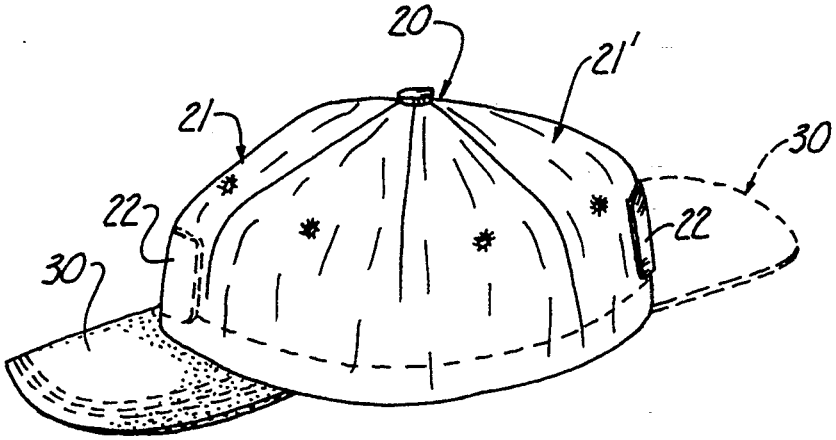
FIG. 6 is a perspective view of an alternate embodiment of the invention.
Figure 7:
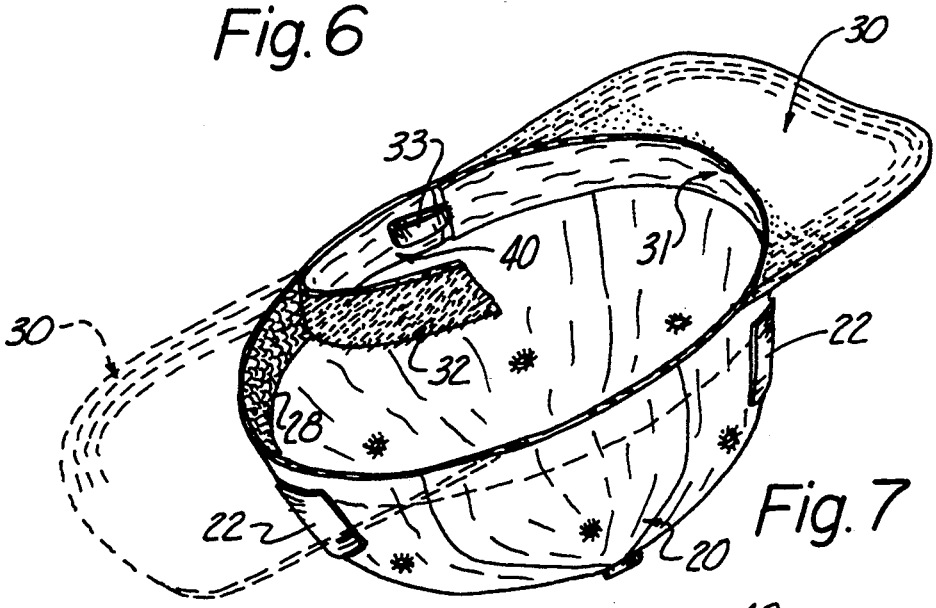
FIG. 7 is an inverted perspective view of the embodiment of FIG. 6.
Figure 8:
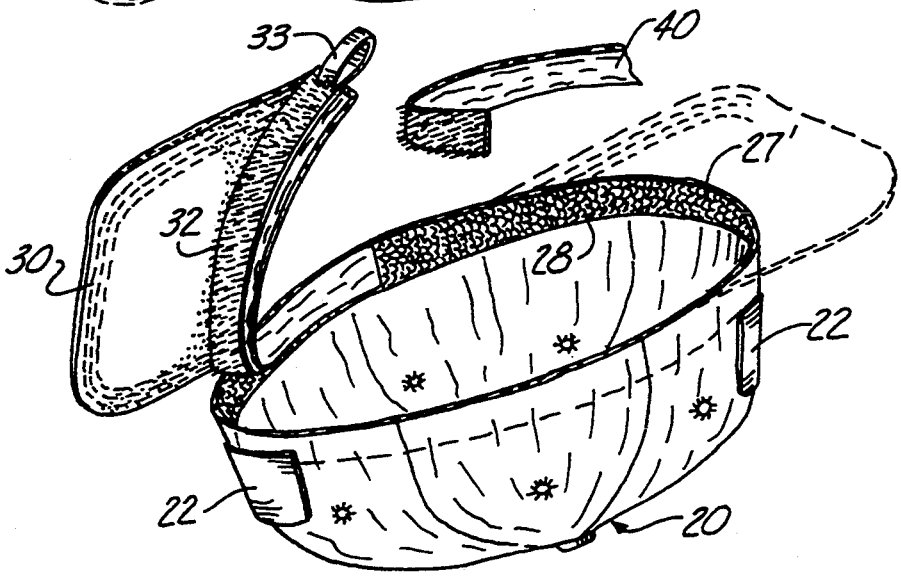
FIG. 8 is a partially exploded perspective view of FIG. 7.

As can also be seen by reference to FIGS. 6 through 8, the alternate version of the preferred embodiment also contemplates providing the cap body member (20) with a reinforced front crown portion (21) and a reinforced rear crown portion (21'); wherein, the only visible differences between the respective front (21) and rear (21') crown portions would be the emblems or logo's (22) associated therewith.

In this manner the user could change their team allegiance merely by attaching a visor member (30) with an appropriate color beneath the crown portion (21) (21') bearing the selected emblem or logo (22).

It should also be noted at this juncture, that even though the alternate version of the preferred embodiment envisions having the softer or "looped" portion of a conventional hook and loop fastening arrangement secured around the inner periphery of the cap body member (20); and, the looped portion can function as a sweat band, there will be instances wherein the contact of the looped portion with the periphery of the users head will be objectionable.

As a consequence of the foregoing situation this invention also contemplates the use of a liner strap (40); wherein, the liner strap (40) may be formed as an extension of the raised lip (31) of the visor member (30) as shown in FIG. 7, or as a separate independent structure as depicted in FIG. 8.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A baseball cap construction consisting of:

a cap body member having a reinforced front crown portion, a reinforced rear crown portion and an inner periphery encircled by an elongated strip of a first hook and loop fastening component;

at least one conventionally configured baseball cap visor unit comprising a generally stiff visor member having a raised inboard lip with a front face covered by a second hook and loop fastening component; and, further provided with a discrete looped tab for facilitating the disengagement of said first and secong hook and loop fastening components from their operative engagement with one another; and, at least one additional conventionally configured baseball cap visor unit comprising a generally stiff visor member having a raised inboard lip with a front face covered by a second hook and loop fastening component.

2. The baseball cap construction as in claim 1, further including: a liner strap adapted to engage at least a portion of the inner periphery of said cap body member.

3. The baseball cap construction as in claim 2, wherein said liner strap is operatively attached to said at least one visor unit.

4. The baseball cap construction as in claim 1; wherein, said at least one additional conventionally configured baseball cap visor unit is also provided with a discrete looped tab for facilitating the disengagement of said first and second hook and loop fastening components from their operative engagement with one another.

5. A baseball cap construction consisting of:

a cap body member having a reinforced front crown portion and an inner periphery encircled by an elongated strip of a first hook and loop fastening component; and, at least one conventionally configured baseball cap visor unit comprising a generally stiff visor member having a raised inboard lip with a front face covered by a second hook and loop fastening component; and, further provided with a discrete looped tab disposed on one end of said inboard lip for facilitating the disengagement of the said first and second hook and loop fastening components from their operative engagement with one another.

6. The baseball cap construction as in claim 5, wherein said at least one conventionally configured baseball cap visor unit is further provided with a liner strap.

7. The baseball cap construction as in claim 6; wherein said liner strap is operatively connected to one end of said inboard lip.

8. The baseball cap construction as in claim 7, wherein said liner strap and said discrete loop are operatively connected to said one end of said inboard lip.

* * * * *